US007849716B2

(12) United States Patent
Lim et al.

(10) Patent No.: US 7,849,716 B2
(45) Date of Patent: Dec. 14, 2010

(54) DRUM TYPE WASHING MACHINE

(75) Inventors: Hee Tae Lim, Bucheon-si (KR); Hyun Seok Seo, Incheon (KR); Min Kyu Jo, Seoul (KR); Jae Won Chang, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 1101 days.

(21) Appl. No.: 11/517,551

(22) Filed: Sep. 8, 2006

(65) Prior Publication Data

US 2007/0051142 A1 Mar. 8, 2007

(30) Foreign Application Priority Data

Sep. 8, 2005 (KR) ..... 10-2005-0083858
Sep. 8, 2005 (KR) ..... 10-2005-0083859

(51) Int. Cl.
*D06F 33/00* (2006.01)

(52) U.S. Cl. ..... 68/12.01; 68/12.19; 68/12.26

(58) Field of Classification Search ..... 68/12.01, 68/12.26, 13 R
See application file for complete search history.

(56) References Cited

U.S. PATENT DOCUMENTS 2,522,806 A 9/1950 Stageberg
2,966,051 A 12/1960 Gerhardt
3,089,327 A * 5/1963 Stilwell, Jr. ..... 68/139
5,881,579 A * 3/1999 Ellingson ..... 68/24
5,979,195 A * 11/1999 Bestell et al. ..... 68/23.2
6,256,823 B1 * 7/2001 Kronbetter et al. ..... 8/158
7,293,437 B2 * 11/2007 Kim et al. ..... 68/23 A
7,357,006 B2 * 4/2008 Kim et al. ..... 68/23.1
7,581,412 B2 * 9/2009 Kim et al. ..... 68/24
2004/0103693 A1 * 6/2004 Kim et al. ..... 68/12.02
2004/0107743 A1 * 6/2004 Kim et al. ..... 68/140
2004/0163426 A1 * 8/2004 Kim et al. ..... 68/23 A
2005/0178168 A1 * 8/2005 Kim et al. ..... 68/23.1
2005/0178169 A1 * 8/2005 Kim et al. ..... 68/23.1
2005/0178170 A1 * 8/2005 Kim et al. ..... 68/24
2006/0174663 A1 * 8/2006 Cimetta et al. ..... 68/3 R

FOREIGN PATENT DOCUMENTS

DE 1968622 U 9/1967
DE 19856973 A1 6/1999
FR 1510533 A 1/1968
FR 2215503 A1 8/1974
GB 1426076 2/1976

* cited by examiner

*Primary Examiner*—Michael Barr
*Assistant Examiner*—Jason Heckert
(74) *Attorney, Agent, or Firm*—McKenna Long & Aldridge LLP

(57) ABSTRACT

A drum type washing machine is disclosed. An object of the present invention is to provide a drum type washing machine having a preventing member which can structurally prevent the laundry from coming between a tub and a drum. When the drum is stopped or rotated at a low speed, an end of the preventing member is in contact with a drum door or the tub. When the drum is rotated at a high speed, the preventing member is separated apart from the drum door or the tub by centrifugal force.

11 Claims, 9 Drawing Sheets

DRUM TYPE WASHING MACHINE

This application claims the benefit of the Patent Korean Application Nos. 10-2005-0083858 and 10-2005-0083859, filed on Sep. 8, 2005, which are hereby incorporated by reference as if fully set forth herein.

BACKGROUND OF THE INVENTION

1. Field of the Invention

The present invention relates to a drum type washing machine, more particularly, to a drum type washing machine provided with a preventing member fastened to a drum to rotate as one body with the drum to prevent a piece of laundry from coming between a tub and the drum.

2. Discussion of the Related Art

FIG. 1 is a sectional view illustrating a conventional drum type washing machine according to the prior art and FIG. 2 is an enlarged view illustrating 'A' portion of FIG. 1.

As shown in the drawings, a conventional drum type washing machine includes a cabinet 111 for defining space therein, a tub 121 horizontally mounted within the cabinet 111 to hold wash water, a drum 131 rotatably mounted within the tub 121 and a driving part 141 for rotatably driving the drum 121.

An opening 113 is formed in front of the cabinet 111 to introduce the laundry and a door 115 is coupled to a circumference of the opening 113.

The tub 121 provided within the cabinet 111 has a cylindrical shape having a front side opened. A plurality of supporting springs 123 are elastically provided on an upper end of the tub 121 along an upward/downward direction. Each first end of the supporting springs 123 is connected to the upper surface of the cabinet 111 and each second end of the supporting springs 123 is connected to the upper surface of the tub 121. A plurality of dampers 125 are provided in a lower portion of the tub 121 to dampen vibration generated along an upward/downward direction of the tub 121. A spider 127 is provided in a rear surface portion of the tub 121 to fasten the driving part 141 thereto.

The drum 131 having a cylindrical shape is rotatably mounted within the tub 121 to hold the laundry therein. A plurality of water supply holes (not shown) are formed on an outer circumferential surface of the drum 131, such that the laundry may be rotated in a state of being soaked in the wash water held in the lower portion of the tub 121.

The driving part 141 supplies driving force to rotate the drum 131. The driving part 141 includes a motor 142, a rotation shaft 145 and a bearing 147. The motor 142 is mounted to a rear surface of the spider 127 of the tub 121, and the rotation shaft 145 is fastened to the drum 131 to transmit the rotation force of the motor 142 to the drum 131. The bearing 147 rotatably supports the rotation shaft 145. Here, the motor 142 includes a stator 142*a* and a rotor 142*b*. The rotation shaft 145 is pressedly inserted in the rotor 142*b*.

According to the conventional drum type washing machine, the tub 121 is hung on the supporting spring 123, not fixed, and vibrated within the cabinet 111 to diffuse the vibration generated by the rotation of the drum 131.

Thus, the door 115 has an inclined surface 115' to form a predetermined distance with an end 121' and 131' of the tub 121 and the drum 131. However, the laundry within the drum 131 during the washing or spinning cycle may be dropped and stuck between the cabinet 111 and the tub 121 through the distance.

To solve the above problem, a gasket 151 having a ring shape is applied to the door 115 to cover the door 115. A first end of the gasket 151 is fastened to the opening 113 of the cabinet 111 and a second end thereof is connected to the end 121' of the opening of the tub 121.

In spite of the gasket 151, the problem has arisen that the laundry is stuck between the inclined surface 115' of the door 115 and the end 121' and 131' of the tub 121 and the drum 131. Furthermore, the laundry may be getting stuck between the tub 121 and the drum 131, because the drum 131 is rotated and vibrated.

Also, while the drum 131 is repeatedly rotating/stopping during the washing, the tub 121 may be collided against the drum 131, resulting in damaging the end 121' and 131' of the tub 121 and the drum 131 or creating noise due to the collision.

SUMMARY OF THE INVENTION

Accordingly, the present invention is directed to a drum type washing machine.

An object of the present invention is to provide a drum type washing machine which can structurally prevent the laundry from coming between a tub and a drum.

Another object of the present invention is to provide a drum type washing machine which can prevent damage or noise due to the collision between the tub and the drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum type washing machine includes a cabinet having an opening formed in front thereof to introduce the laundry and a door coupled thereto to open/close the opening; a tub mounted within the cabinet to hold wash water; a drum rotatably mounted within the tub; a driving part for supply rotation force to the drum; and a preventing member flexible and having a first end connected to the drum and a second end in contact with the drum door or the tub to prevent a piece of the laundry from entering between the tub and the drum.

Preferably, the second end of the preventing member is separated apart from the drum door or the tub when the drum is rotated at a high speed.

The second end of the preventing member is in contact with an inclined part of the drum door.

Also, the second end of the preventing member may extend toward an inside of the drum to be in contact with the drum door.

Preferably, the preventing member is a gasket.

The second end of the gasket may have at least one cut part.

The second end of the gasket may be held in a curling part of the end of the drum.

The second end of the preventing member may be in contact with the tub. Preferably, the second end of the preventing member extends an outward direction of the drum.

At least some portion of the preventing member may be formed as brush.

Preferably, a guide member projected toward the tub from the end of the drum is further provided to make the preventing member turn toward the tub.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
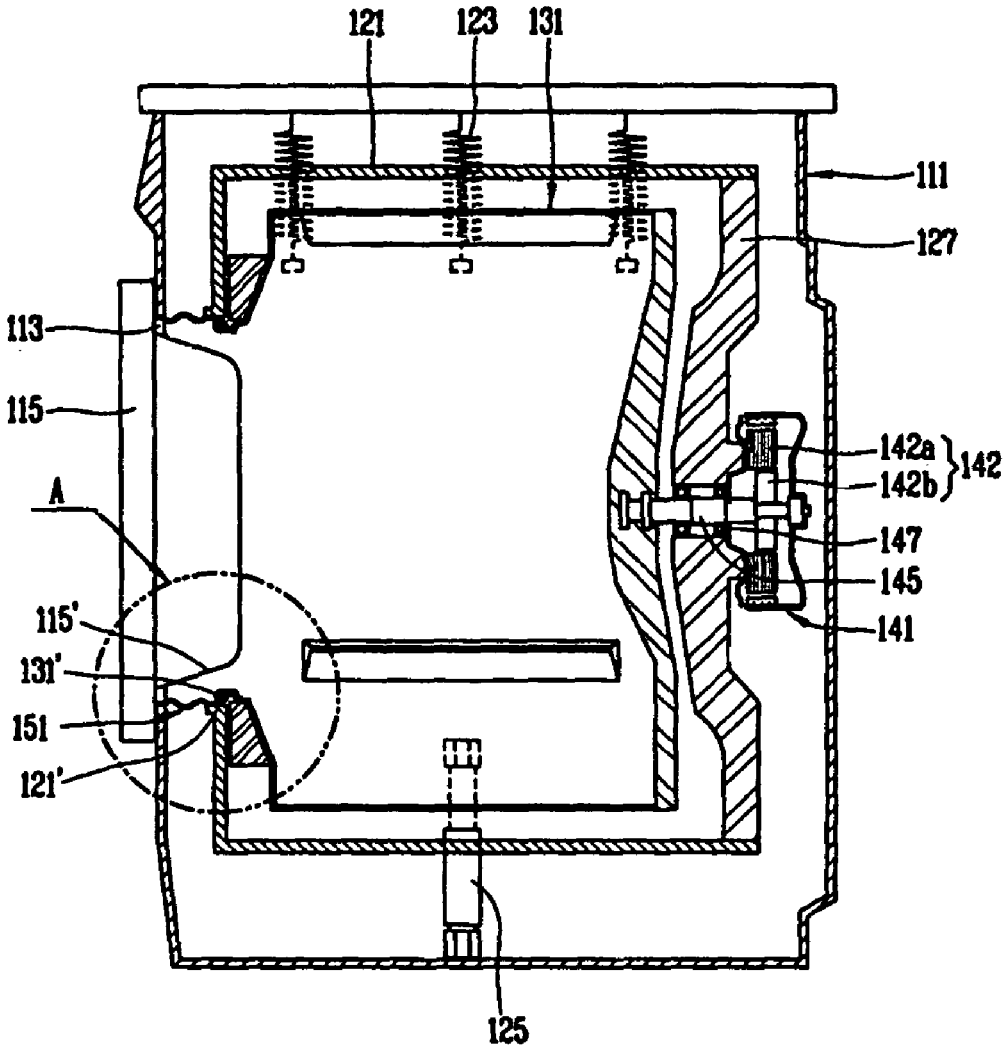
Fig. 1 Prior Art
FIG. 1 is a sectional view illustrating a conventional drum type washing machine according to the prior art.
Figure 2:
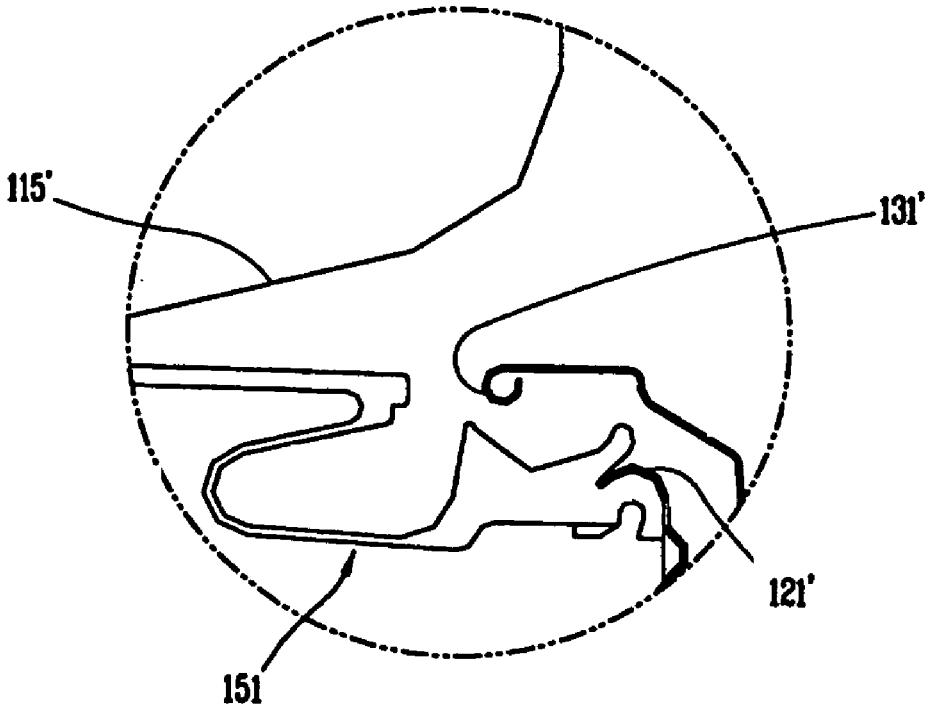
Fig. 2 Prior Art
FIG. 2 is a diagram enlarging an 'A' portion of FIG. 1
Figure 3:
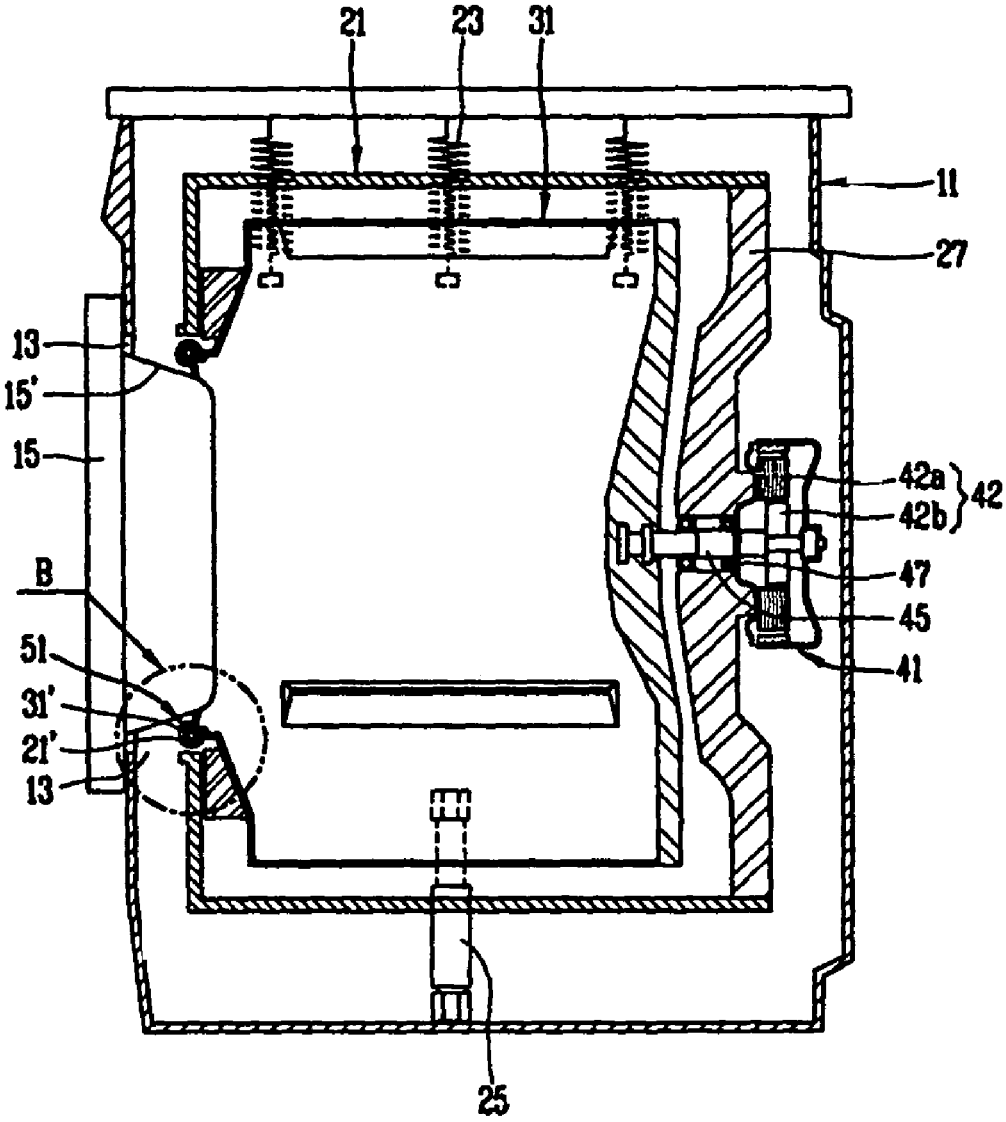
FIG. 3 is a sectional view illustrating a drum type washing machine according to a preferred embodiment of the present invention.
Figure 4:
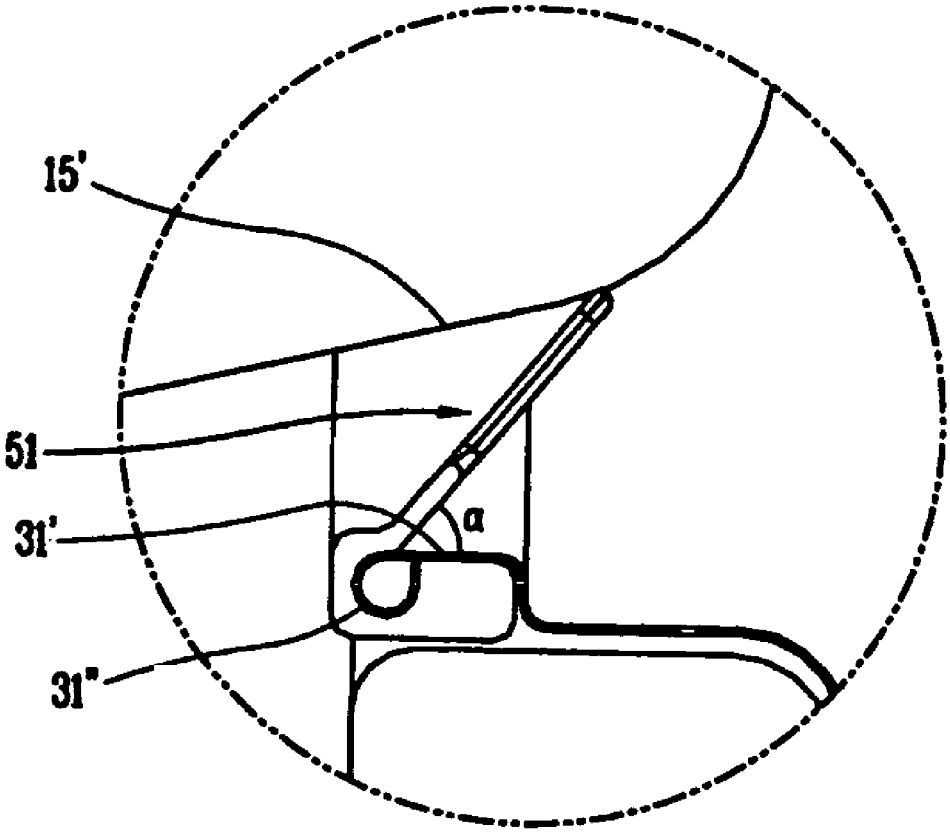
FIG. 4 is a diagram enlarging a 'B' portion of FIG. 3.

FIG. 3 is a sectional view illustrating a drum type washing machine according to a preferred embodiment of the present invention and FIG. 4 is a diagram enlarging a 'B' portion of FIG. 3.

Referring to FIG. 3, the drum type washing machine according to the present invention includes a cabinet 11 for defining predetermined inner space thereof, a tub 21 vibratilely mounted within the cabinet 11, a drum 31 rotatably mounted within the tub 21, a driving part 41 for generating driving force to rotate the drum 31 and a gasket 51 for shutting off an aperture between the drum 31 and a drum door 15.

The cabinet 11 is a cylindrical casing having an opening 13 formed in front thereof to introduce the laundry there through. The drum door 15 is coupled to the opening 13 of the cabinet 11 to open/close the opening 13. The drum door 15 is projected toward the drum 31 to have an inclined part 15', such that predetermined space is formed between the drum 31 and the drum door 15.

The tub 21 is vibratilely mounted within the cabinet 11 by a plurality of supporting springs 23. Furthermore, a downside of the tub 21 is supported by a damper 25. An end 21' of the tub 21 is corresponding to the opening 13 of the cabinet 11 and wash water is stored within the tub 21. Also, a spider 27 is fastened to a rear surface of the tub 21 and the driving part 41 is mounted to the spider 27.

The drum 31 is mounted within the tub 21 and rotated by the driving part 41. An end 31' of the opening of the drum 31 is toward the opening 13 of the cabinet 11. Also, wash water supplied into the tub 21 is received through a plurality of water-through holes (not shown) formed on the drum 31 to wash the laundry.

The driving part 41 supplies driving force to rotate the drum 31, and mounted in a rear surface of the spider 27 of the tub 21. A motor 42 includes a stator 42*a* and a rotor 42*b*, and a rotation shaft 45 is pressely inserted in the rotor 42*b*. The rotation shaft 45 is rotatably supported by a bearing 47 provided in the spider 27 and an end of the rotation shaft 43 is fastened to the drum 31.

A first end of the gasket 51 is fixed to the end 31' of the opening of the drum 31 and a second end thereof is a rubber member projected toward the inclined part 15' of the drum door 15. The gasket 51 is provided along a circumference of the circular opening of the drum 31 in a ring shape.

According to this embodiment, as shown in FIG. 4, the second end of the gasket 51 extends toward an inside of the drum 31, and alternatively, as needed, the second end of the gasket 51 may extends in an outward direction of the drum 31.

As described more specifically referring to FIG. 4, the first end of the gasket 51 is insertedly fastened to a curling part 31" curly formed in the end 31' of the opening of the drum 31. The angle between the gasket 51 and a line extended from the end 31' of the opening of the drum 31 is an acute angle ($\alpha$).

Figure 5:
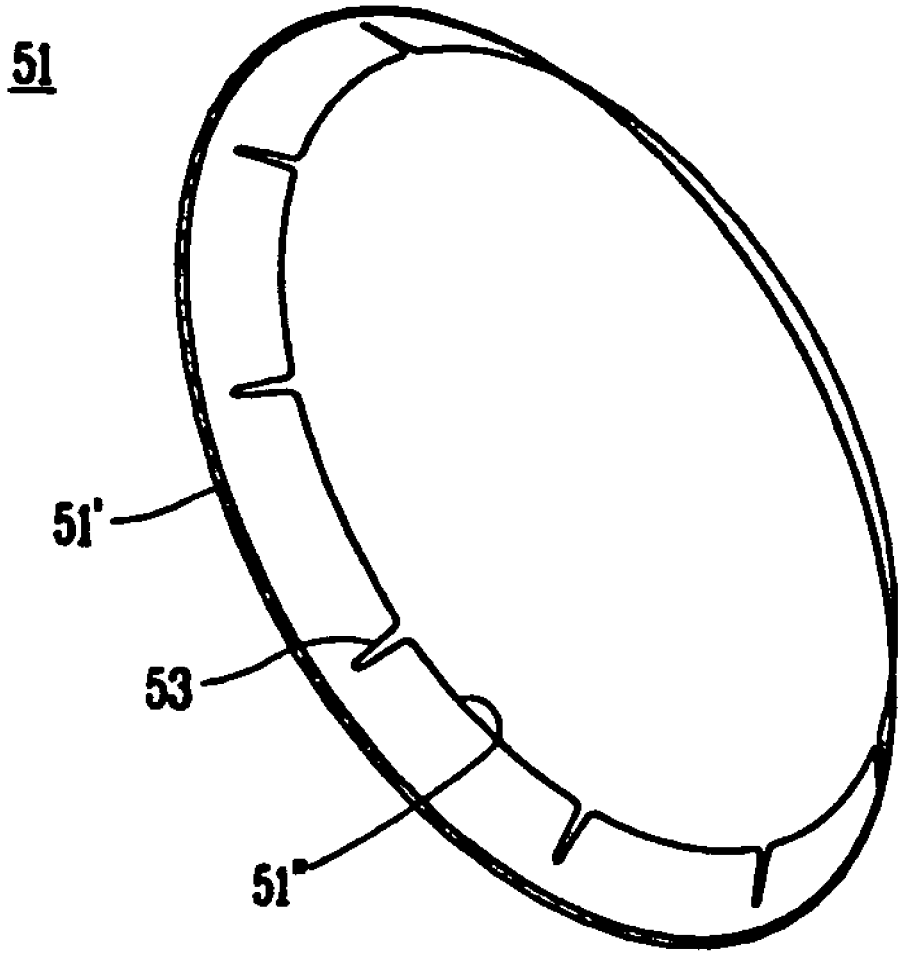
FIG. 5 is a perspective view illustrating a gasket as a preventing member.
Figure 6:
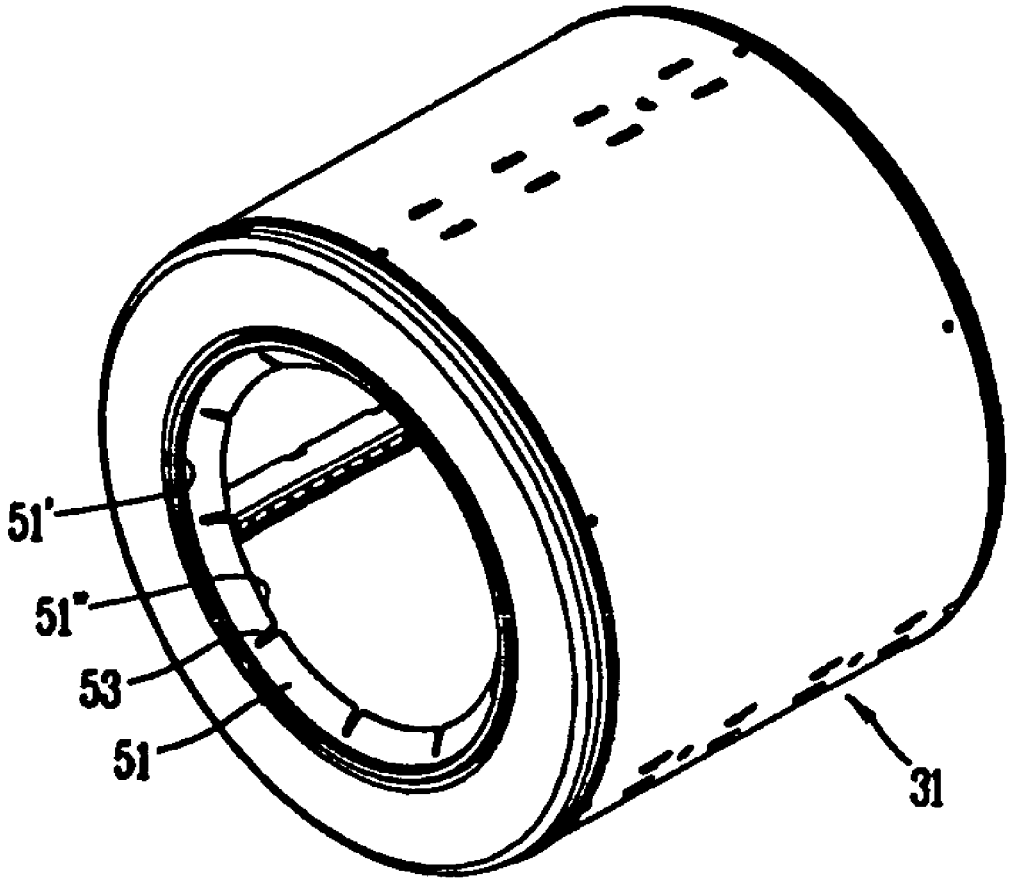
FIG. 6 is a diagram illustrating a drum having the gasket of FIG. 5 fastened thereto.

FIG. 5 is a perspective view illustrating the gasket.

As shown in the drawings, the first end 51' of the gasket 51 fastened to the curling part 31" of the drum 31 is continuously formed, and the second end 51" thereof connected to the inclined part 15' of the drum door 15 has at least one cut part 53 cut along a circumference in a predetermined or irregular distance.

The cut part 53 may be cut in a V-shape. The first end 51' of the gasket 51 has a bigger diameter than the second end 51" thereof, and the second end 51" tends to separate apart from the drum 31 due to the elasticity, in case that the drum 31 is rotated in a low speed. That is because the first end 51' of the gasket is fastened to the drum 31.

When the drum 31 is stopped or rotated in a low speed such as in a washing cycle, the second end 51" of the gasket 51 is flexible to separate apart from the drum 31. Thus, the second end 51" of the gasket 51 maintains a state of being in contact with the inclined part 15' of the drum door 15. Thereby, the aperture between the end 31' of the drum 31 and the drum door 15 is shut off by the gasket 51, such that the laundry may be prevented from entering the aperture between the tub 21 and the drum 31. Accordingly, the laundry may be prevented from coming between the tub 21 and the drum 31.

Also, since the gasket 51 is made of flexible material such as rubber, the drum door 15 is not deformed or noise is not generated.

When the drum 31 is rotated at a high speed, for example, more than 500 rpm in a spinning cycle, the second end 51" of the gasket 51 is separated from the drum door 15 by centrifugal force and pressed toward the inside of the drum 31. That is performed smoothly by the drum door 15, because the angle between the gasket and the end 31' of the opening of the drum 31 is an acute angle ($\alpha$).

In the high speed rotation or spinning cycle, wash water within the tub 21 is drained and, together with that, the drum 31 is rotated at a high speed. Hence, the laundry is pressed on an inner circumferential surface of the drum 31 by centrifugal force and the laundry may not leave out of the drum 31. Thus, the gasket 51 need not maintain the state of being in contact with the drum door 15. Thereby, the second end 51" of the gasket 51 is completely separated from the drum 31. Therefore, the gasket 51 of the present invention has an advantageous effect that noise generated by the friction between the gasket 51 and the drum door 15 is prevented during the rotation of the drum 31 at a high speed.

Still more, since the gasket 51 has the cut part 53 in case that the second end 51" of the gasket 51 is inserted in the drum 31 and held in the end 31' of the drum 31, the gasket 51 may not be deformed or distorted and the end 51" of the gasket 51 may be securely fixed to the end 31' of the drum 31.

Next, referring to the drawings, another embodiment of the present invention will be described.

Figure 7:
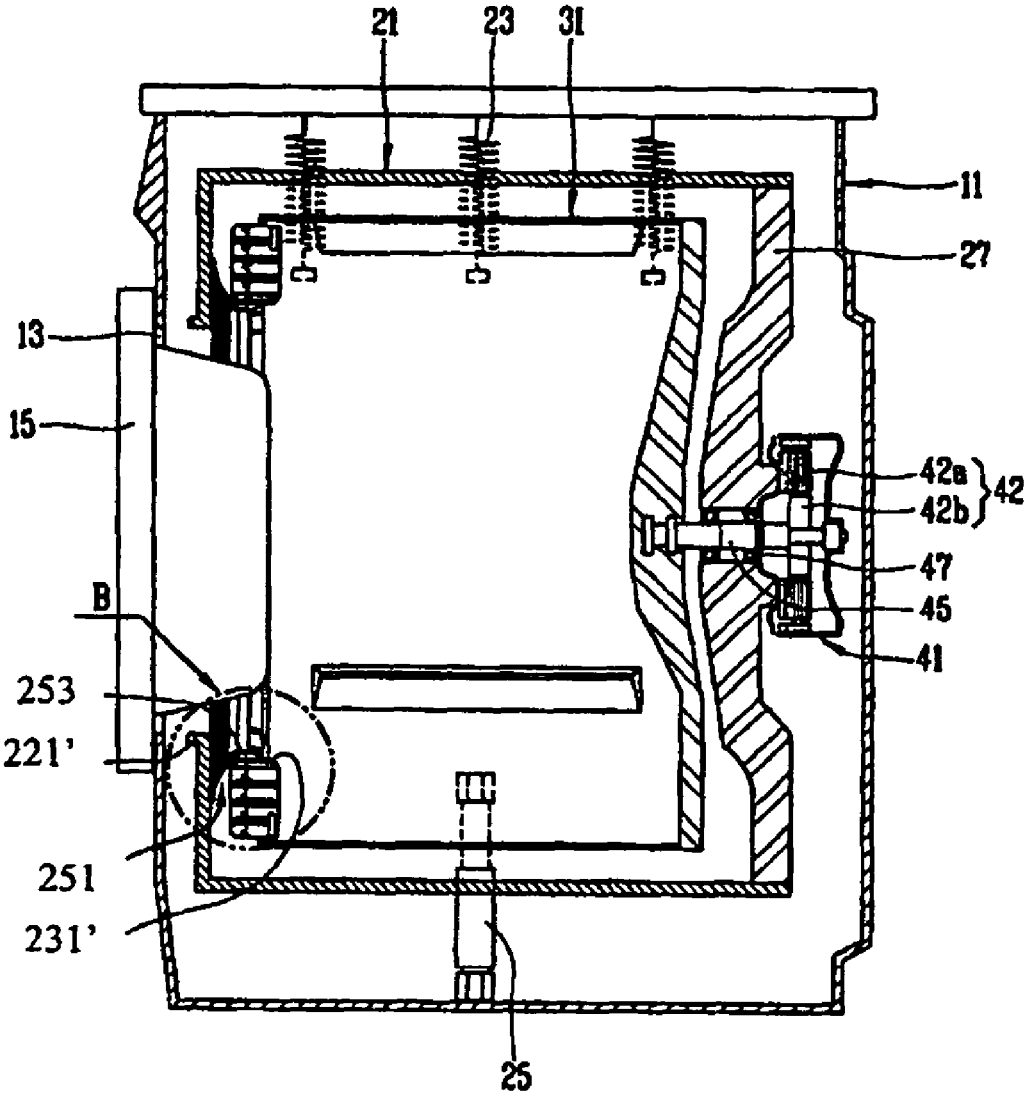
FIG. 7 a sectional view illustrating a drum type washing machine according to another embodiment of the present invention.
Figure 8:
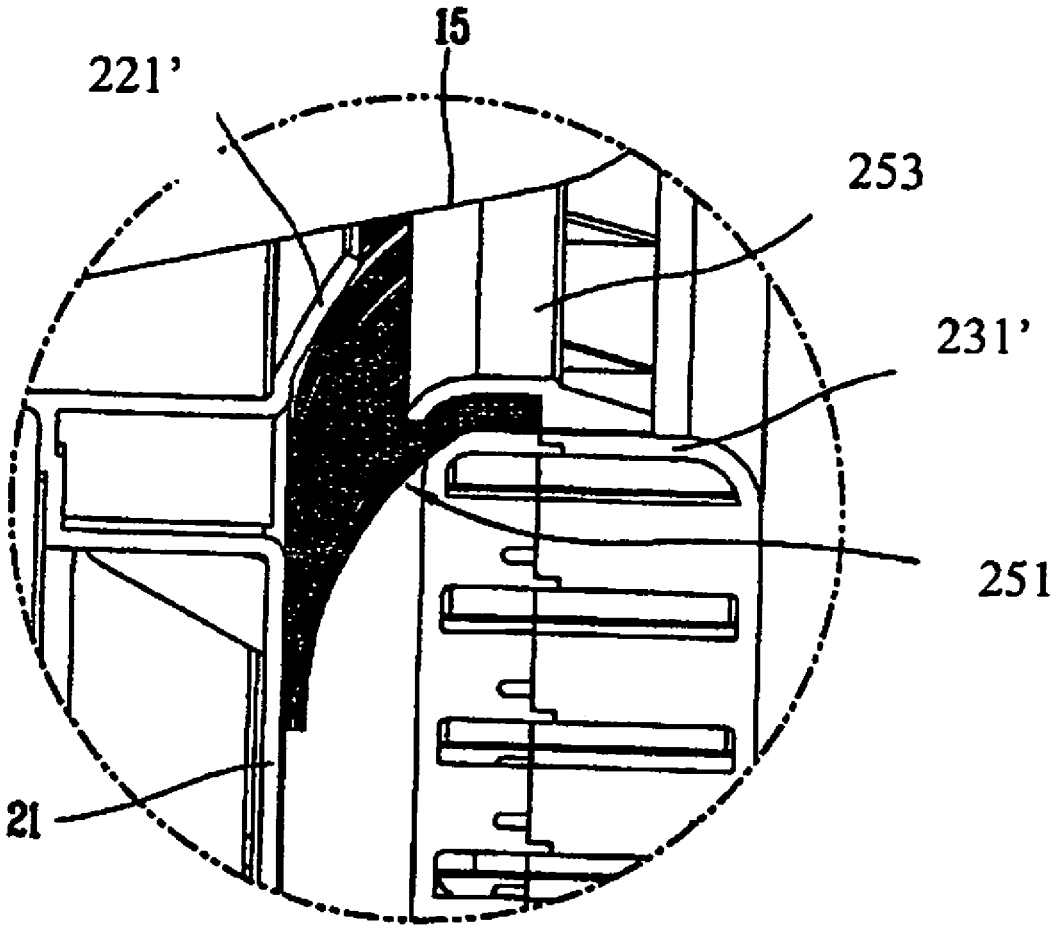
FIG. 8 an enlarged view illustrating a 'B' portion of FIG. 7.

FIG. 7 is a sectional view illustrating a drum type washing machine according to another embodiment of the present invention and FIG. 8 is an enlarged view illustrating a 'B' portion of FIG. 7.

First of all, referring to FIG. 7, the drum type washing machine according to another embodiment of the present invention includes a cabinet 11 for defining predetermined inner space thereof, a tub 21 vibratilely mounted within the cabinet 11, a drum 31 rotatably mounted within the tub 21, a driving part 41 for generating driving force to rotate the drum 31 and a preventing member 251 extending toward the tub 21 from the drum 31 to shut off space between the tub 21 and the drum 31.

The preventing member 251 is a ring shaped member fastened to the drum 31, and a first end thereof is fastened to the drum 31 and a second end thereof is extended toward the tub 21 to be contacted with the tub 21.

The preventing member 251 is formed as a brush made of plural threads. A guide member 253 projected toward the tub 21 is fastened to an end 231' of the drum 31 to turn the preventing member or the brush 251 toward the tub 21. The guide member 253 is made of flexible material such as rubber, such that the guide member 253 may not be damaged by the collision against the tub 21.

Figure 9:
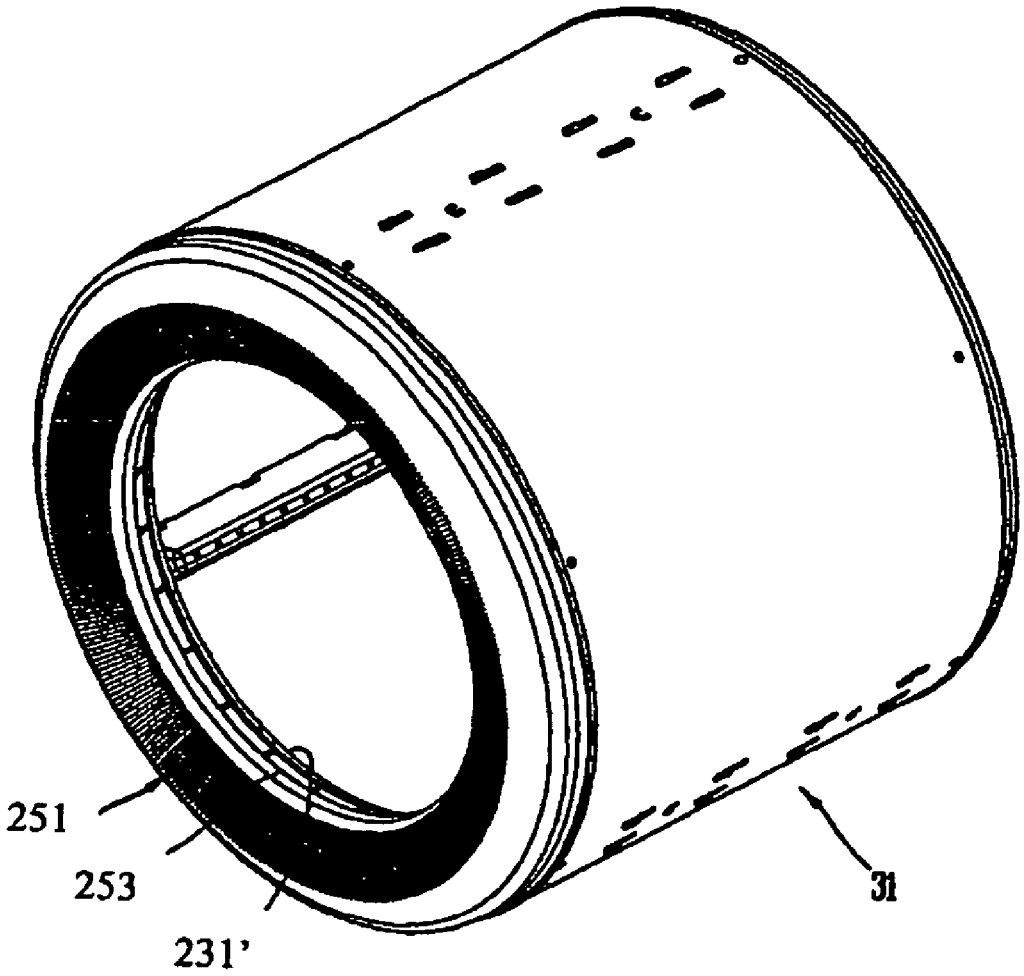
FIG. 9 is a diagram illustrating a drum provided in the drum type washing machine of FIG. 7.

Referring to FIGS. 7 to 9, an operation of the drum type washing machine according to the above embodiment of the present invention will be described.

The brush 251 is in contact with the tub 21 while the drum 31 is stopped or rotated at a low speed. Also, the brush 251 is rotated together with the drum 31 as one body in a state of being in contact with the tub 21 by the guide member 253, without being over an end 221' of the tub 21 and separated.

Thus, the laundry may not enter the space between the tub 21 and the drum 31. Still more, even in case of the collision between the vibrating tub 21 and the rotating drum 31, shock due to the collision may be dampened by the brush 251 and noise generated due to the collision may be absorbed by the brush 251.

When the drum 31 is rotated at a high speed, for example, approximately 500 rpm, the laundry is rotated in a state of being pressed on the inner circumferential surface of the drum 31 by centrifugal force. Thereby, the problem of the laundry stuck between the tub 21 and the drum 31 may not arise.

Still further, the brush 251 also may be separated from the tub 21 by the centrifugal force. Thus, abrasion or noise of the brush 251 due to the contact with the tub 21 may be prevented.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum type washing machine comprising:

a cabinet having an opening formed in front thereof to introduce the laundry and a door coupled thereto to open/close the opening;

a tub mounted within the cabinet to hold wash water;

a drum rotatably mounted within the tub;

a driving part to supply a rotational force to the drum; and a flexible preventing member having a first end connected to the drum and a second end in contact with the drum door or the tub to be rotated along with the drum so as to prevent a piece of the laundry from entering between the tub and the drum, wherein the second end of the preventing member is separated apart from the drum door or the tub when the drum is rotated at a high speed.

2. The drum type washing machine as claimed in claim 1, wherein the second end of the preventing member is in contact with the drum door.

3. The drum type washing machine as claimed in claim 2, wherein the second end of the preventing member is in contact with an inclined part of the drum door.

4. The drum type washing machine as claimed in claim 2, wherein the second end of the preventing member extends toward an inside of the drum.

5. The drum type washing machine as claimed in claim 2, wherein the preventing member is a gasket.

6. The drum type washing machine as claimed in claim 5, wherein the second end of the gasket has at least one cut part.

7. The drum type washing machine as claimed in claim 5, wherein the second end of the gasket is held in a curling part of the end of the drum.

8. The drum type washing machine as claimed in claim 1, wherein the second end of the preventing member is in contact with the tub.

9. The drum type washing machine as claimed in claim 8, wherein the second end of the preventing member extends an outward direction of the drum.

10. The drum type washing machine as claimed in claim 8 wherein at least some portion of the preventing member is formed as a brush.

11. The drum type washing machine as claimed in claim 9, further comprising a guide member projected toward the tub from the end of the drum to make the preventing member turn toward the tub.

* * * * *